US008930090B2

(12) United States Patent
Okamura et al.

(10) Patent No.: US 8,930,090 B2
(45) Date of Patent: Jan. 6, 2015

(54) CONSTRUCTION EQUIPMENT, METHOD FOR CONTROLLING CONSTRUCTION EQUIPMENT, AND PROGRAM FOR CAUSING COMPUTER TO EXECUTE THE METHOD

(75) Inventors: Kenji Okamura, Hiratsuka (JP); Masashi Ichihara, Hiratsuka (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 313 days.

(21) Appl. No.: 13/254,952

(22) PCT Filed: Mar. 5, 2010

(86) PCT No.: PCT/JP2010/053606

§ 371 (c)(1),
(2), (4) Date: Sep. 6, 2011

(87) PCT Pub. No.: WO2010/101234

PCT Pub. Date: Sep. 10, 2010

(65) Prior Publication Data

US 2011/0318155 A1 Dec. 29, 2011

(30) Foreign Application Priority Data

Mar. 6, 2009 (JP) ..... 2009-053942

(51) Int. Cl.

| | |
|---|---|
| ***B66C 23/00*** | (2006.01) |
| ***G06F 19/00*** | (2011.01) |
| ***E02F 9/22*** | (2006.01) |
| *E02F 3/43* | (2006.01) |
| *E02F 9/14* | (2006.01) |

(52) U.S. Cl.

CPC ..... *E02F 9/2203* (2013.01); *E02F 3/435* (2013.01); *E02F 9/14* (2013.01)

USPC ..... 701/50; 414/685

(58) Field of Classification Search

CPC ..... E02F 9/14; E02F 3/435; E02F 9/2203

USPC ..... 414/685; 701/50

See application file for complete search history.

(56) References Cited

U.S. PATENT DOCUMENTS 4,075,895 A * 2/1978 Eyman ..... 74/61
4,467,652 A * 8/1984 Thurner et al. ..... 73/573

(Continued)

FOREIGN PATENT DOCUMENTS

CN 1347818 A 5/2002
CN 1655076 A 8/2005

(Continued)

OTHER PUBLICATIONS

Notice of Reason(s) for Rejection dated Dec. 4, 2012 from Japanese Application No. 2009-053942, including English translation thereof, 3 pages.

(Continued)

*Primary Examiner* — Calvin Cheung
*Assistant Examiner* — Angelina Shudy
(74) *Attorney, Agent, or Firm* — Fish & Richardson P.C.

(57) ABSTRACT

A construction machine includes: a working equipment; a manipulating unit that manipulates the working equipment; and a controller that controls the working equipment. The controller includes: a rolling compaction determining unit that determines whether or not the working equipment is under a rolling compaction operation for hardening earth and sand through reciprocation; and a command output regulating unit that controls the working equipment so that a motion speed of the working equipment does not exceed a predetermined maximum value when the rolling compaction determining unit determines that the working equipment is under the rolling compaction operation.

6 Claims, 18 Drawing Sheets

(56) References Cited

U.S. PATENT DOCUMENTS

| | | | | |
|---|---|---|---|---|
| 4,493,585 | A * | 1/1985 | Axer | 404/102 |
| 4,984,956 | A * | 1/1991 | Ikari et al. | 414/699 |
| 5,164,641 | A * | 11/1992 | Quibel et al. | 318/128 |
| 5,527,156 | A * | 6/1996 | Song | 417/2 |
| 5,826,666 | A | 10/1998 | Tozawa et al. | |
| 5,999,872 | A * | 12/1999 | Kinugawa et al. | 701/50 |
| 6,308,516 | B1 * | 10/2001 | Kamada | 60/450 |
| 2002/0073699 | A1 | 6/2002 | Nishimura et al. | |
| 2005/0177292 | A1 | 8/2005 | Okamura et al. | |
| 2007/0239472 | A1 * | 10/2007 | Anderson | 705/1 |
| 2009/0018729 | A1 * | 1/2009 | Sahlin et al. | 701/50 |
| 2009/0218112 | A1 * | 9/2009 | Mintah et al. | 172/1 |
| 2009/0228177 | A1 * | 9/2009 | Mintah et al. | 701/50 |
| 2011/0318157 | A1 * | 12/2011 | Okamura et al. | 414/687 |
| 2012/0004816 | A1 * | 1/2012 | Okamura et al. | 701/50 |
| 2012/0227389 | A1 * | 9/2012 | Hinderks | 60/317 |
| 2013/0042935 | A1 * | 2/2013 | Post et al. | 137/561 R |

FOREIGN PATENT DOCUMENTS

| | | | |
|---|---|---|---|
| EP | 632165 | A1 * | 1/1995 |
| EP | 0 791 694 | A1 | 8/1997 |
| EP | 1705293 | A1 * | 9/2006 |
| EP | 1985760 | A1 * | 10/2008 |
| JP | S54-091687 | A | 7/1979 |
| JP | H06-336747 | A | 12/1994 |
| JP | 2005-256595 | A | 9/1995 |
| JP | 09-228404 | A | 9/1997 |
| JP | 2007-177437 | A | 7/2007 |

OTHER PUBLICATIONS

International Search Report from International Application No. PCT/JP2010/053606, mailed Jun. 8, 2010, 1 page.

Office Action issued Jul. 24, 2013 in corresponding Chinese Application No. 201080010355.9, including English translation, 9 pages.

Office Action dated May 23, 2014 in correspondding Chinene Patent Application No. 201080010355.9, including English translation, 9 pages.

* cited by examiner

CONSTRUCTION EQUIPMENT, METHOD FOR CONTROLLING CONSTRUCTION EQUIPMENT, AND PROGRAM FOR CAUSING COMPUTER TO EXECUTE THE METHOD

CROSS REFERENCE TO RELATED APPLICATIONS

This application claims priority to Application No. PCT/JP2010/053606 filed on Mar. 5, 2010, which application claims priority to Japanese Application No. 2009-053942, filed on Mar. 6, 2009. The entire contents of the above applications are incorporated herein by reference in their entireties.

TECHNICAL FIELD

The present invention relates to a construction machine, a method for controlling the construction machine, and a program for causing a computer to execute the method.

BACKGROUND ART

A construction machine such as a hydraulic excavator carries out various types of works by moving a working equipment including a boom, an arm, a bucket and the like.

For instance, for a surface preparation of the ground by hardening earth and sand (a rolling compaction operation), a working equipment lever is reciprocated in a short cycle over a neutral position to move the boom up and down, thereby beating the earth and sand with a bottom of the bucket attached to a tip of the boom (see, for instance, Patent Literature 1).

CITATION LIST

Patent Literature

Patent Literature 1 JP-A-2005-256595

SUMMARY OF THE INVENTION

Problem to be Solved by the Invention

In the technique of Patent Literature 1, in the rolling compaction operation, the boom is moved at a motion speed in accordance with a manipulation amount of the working equipment lever (hereinafter referred to as a lever manipulation amount), so that the following disadvantages arise.

In a construction machine such as a hydraulic excavator, in order to combine a slow motion when a lever manipulation amount is small and the maximum speed motion when the lever manipulation amount is large, a relation between the lever manipulation amount and a cylinder speed is often made so as to be represented by a U-shape as shown in FIG. 18A. Accordingly. a slight difference in the lever manipulation amount results in a large difference in the cylinder speed.

In the rolling compaction operation, a working equipment needs to be reciprocated in a substantially predetermined amplitude and rhythm. When the amplitude of the lever manipulation amount inputted by an operator fluctuates as shown in an upper part of FIG. 18B, the cylinder speed widely fluctuates as shown in a lower part of FIG. 18B. Thus, the working equipment beats the ground too hard with a bucket or a front portion of a vehicle body is lifted, thereby causing large vibration on the vehicle body.

Accordingly, for performing the rolling compaction operation, the operator needs to carefully manipulate the working equipment lever so as to avoid a careless increase in the lever manipulation amount.

An object of the invention is to provide a construction machine capable of improving operability of the working equipment, a method for controlling the construction machine, and a program for causing a computer to execute the method.

Means for Solving the Problems

A construction machine according to a first aspect of the invention includes: a working equipment; a manipulating unit that manipulates the working equipment; and a controller that controls the working equipment, in which the controller includes a rolling compaction determining unit that determines whether or not the working equipment is under a rolling compaction operation for hardening earth and sand through reciprocation; and a command output regulating unit that controls the working equipment so that a motion speed of the working equipment does not exceed a predetermined maximum value when the rolling compaction determining unit determines that the working equipment is under the rolling compaction operation.

In the construction machine according to a second aspect of the invention, the controller includes a manipulation information acquiring unit that acquires manipulation information on manipulation conditions of the manipulating unit, and the rolling compaction determining unit determines whether or not the working equipment is under a rolling compaction operation based on the manipulation information.

Herein, examples of applicable manipulation information includes: a manipulating signal outputted from the manipulating unit when the manipulating unit is provided by an electric lever; and a pressure signal outputted from a pressure sensor attached to a hydraulic lever when the manipulating unit is provided by the hydraulic lever.

In the construction machine according to a third aspect of the invention, the command output regulating unit includes: a command output limiter that regulates command output of the working equipment so that the motion speed of the working equipment does not exceed the maximum value; a cycle computing unit that computes a manipulation cycle of the manipulating unit based on the manipulation information; and a maximum value changing unit that changes the maximum value based on the manipulation cycle.

A method according to a fourth aspect of the invention is based on development of the construction machine according to the first aspect of the invention.

Specifically, a method for controlling a construction machine including a working equipment, a manipulating unit that manipulates the working equipment, and a controller that controls the working equipment, the method performed by the controller including: determining whether or not the working equipment is under a rolling compaction operation for hardening earth and sand through reciprocation; and when determining that the working equipment is under the rolling compaction operation, controlling the working equipment so that a motion speed of the working equipment does not exceed a predetermined maximum value.

A fifth aspect of the invention relates to a computer-executable program of causing a controller of a construction machine to execute the method according to the fourth aspect of the invention.

In the first aspect of the invention, when the working equipment is under the rolling compaction operation, the motion speed of the working equipment can be regulated so as not to exceed a predetermined maximum value.

Specifically, under the rolling compaction operation, even when the manipulation unit (e.g., the working equipment lever) is inclined at a maximum mechanical inclination angle, a command output value is not a value corresponding to the maximum inclination angle of the lever but a maximum value regulated by the command output regulating unit, whereby an opening amount of a manipulation valve and a cylinder flow rate passing through the manipulation valve are regulated. Accordingly, while the motion speed of the working equipment is regulated at the maximum value, the working equipment slowly moves at a speed of the maximum value. With this arrangement, even when the operator carelessly increases the manipulation amount of the manipulation unit for performing the rolling compaction operation, the vehicle body does not swing heavily. Accordingly, it is not required to carefully manipulate the manipulation unit, thereby improving operability of the working equipment.

On the other hand, during operations other than the rolling compaction operation, the working equipment quickly moves at a speed corresponding to the manipulation amount of the manipulating unit without the motion speed thereof being regulated.

In other words, in the rolling compaction operation, the maximum motion speed of the working equipment (the motion speed of the working equipment when the manipulation amount of the manipulating unit is the maximum) is reduced. In other operations, the maximum motion speed of the working equipment is increased. With this arrangement, the maximum motion speed of the working equipment is changeable depending on working contents. Accordingly, without deteriorating operability during operations other than the rolling compaction operation, operability under the rolling compaction operation is improvable.

In the second aspect of the invention, manipulation information on manipulation conditions of the manipulating unit is acquired and the determination processing of the rolling compaction operation is performed based on the acquired manipulation information. Thus, it is automatically determined whether or not the working equipment is under the rolling compaction operation. With this automatic determination, an additional arrangement (e.g., a switch manipulated by the operator) for allowing the controller to recognize that the working equipment is under a rolling compaction operation is not required, thereby simplifying the arrangement of the construction machine.

In the third aspect of the invention, the maximum value that regulates the motion speed of the working equipment is changed based on the manipulation cycle to the manipulating unit.

Specifically, when the operator reciprocates the manipulating unit in a relatively long cycle for the rolling compaction operation, since the maximum motion speed of the working equipment is set at a large value (the first maximum value), the working equipment can be quickly moved and beat the earth and sand strongly although the vehicle body slightly swings.

Alternatively, when the operator reciprocates the manipulating unit in a relatively short cycle for the rolling compaction operation, since the maximum motion speed of the working equipment is set at a small value (the second maximum value), the working equipment can be rhythmically reciprocated in a predetermined cycle while keeping slow movement.

Thus, since the maximum motion speed of the working equipment can be changed by the manipulation of the operation even in the rolling compaction operation, operability of the working equipment can be further improved.

According to the fourth aspect of the invention, the same action and advantages as those in the first aspect of the invention can be obtained.

According to the fifth aspect of the invention, the method according to the fourth aspect of the invention can be carried out only by installing a program on a controller of a general construction machine provided with a controller, so that the invention can be significantly popularized.

DESCRIPTION OF EXEMPLARY EMBODIMENTS

Exemplary embodiments of the invention will be described below with reference to the drawings.

First Exemplary Embodiment (1) Overall Structure

Figure 1:
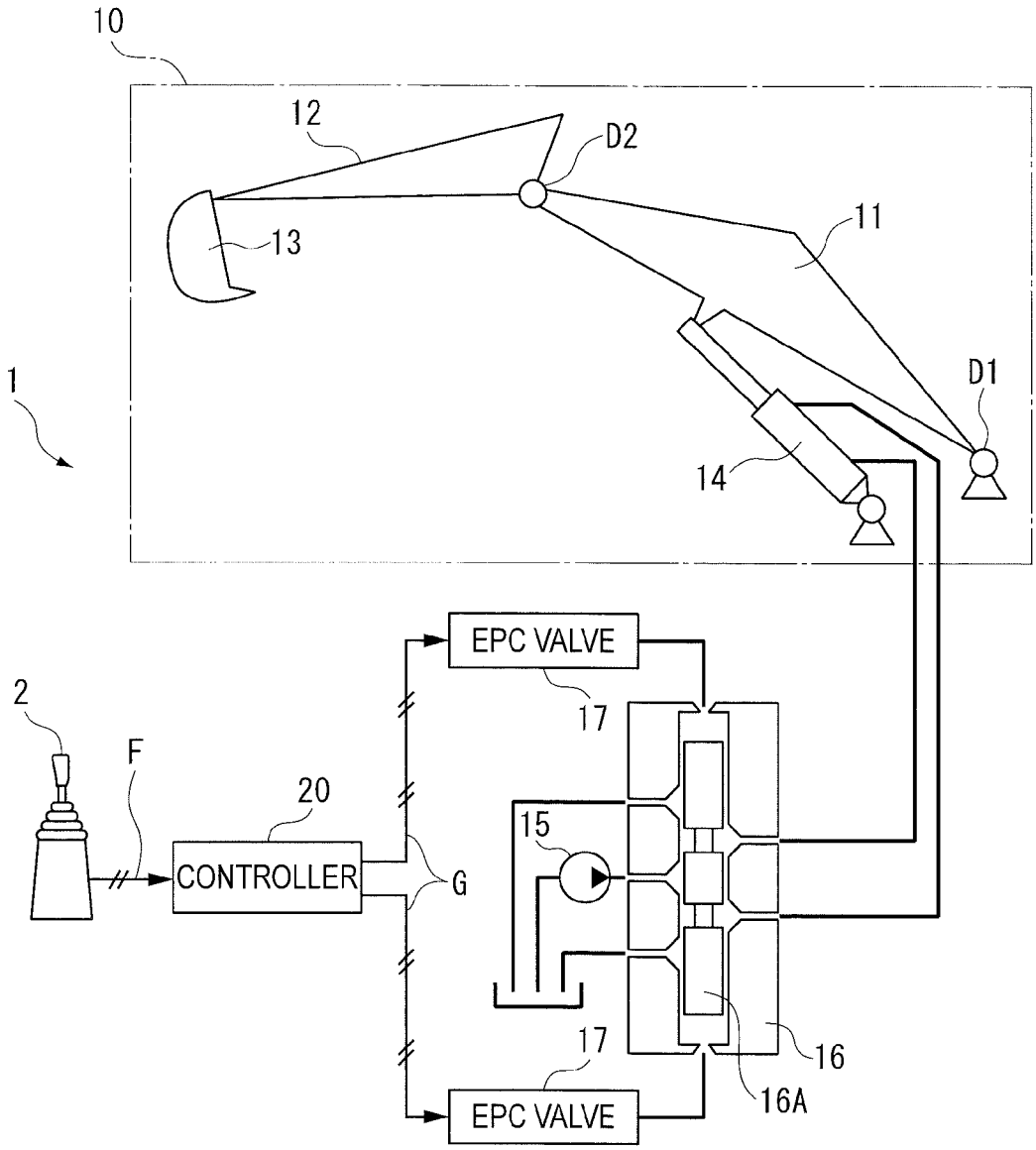
FIG. 1 is a schematic diagram showing a construction machine on which a working equipment and a controller thereof are installed according to a first exemplary embodiment of the invention.
Figure 2:
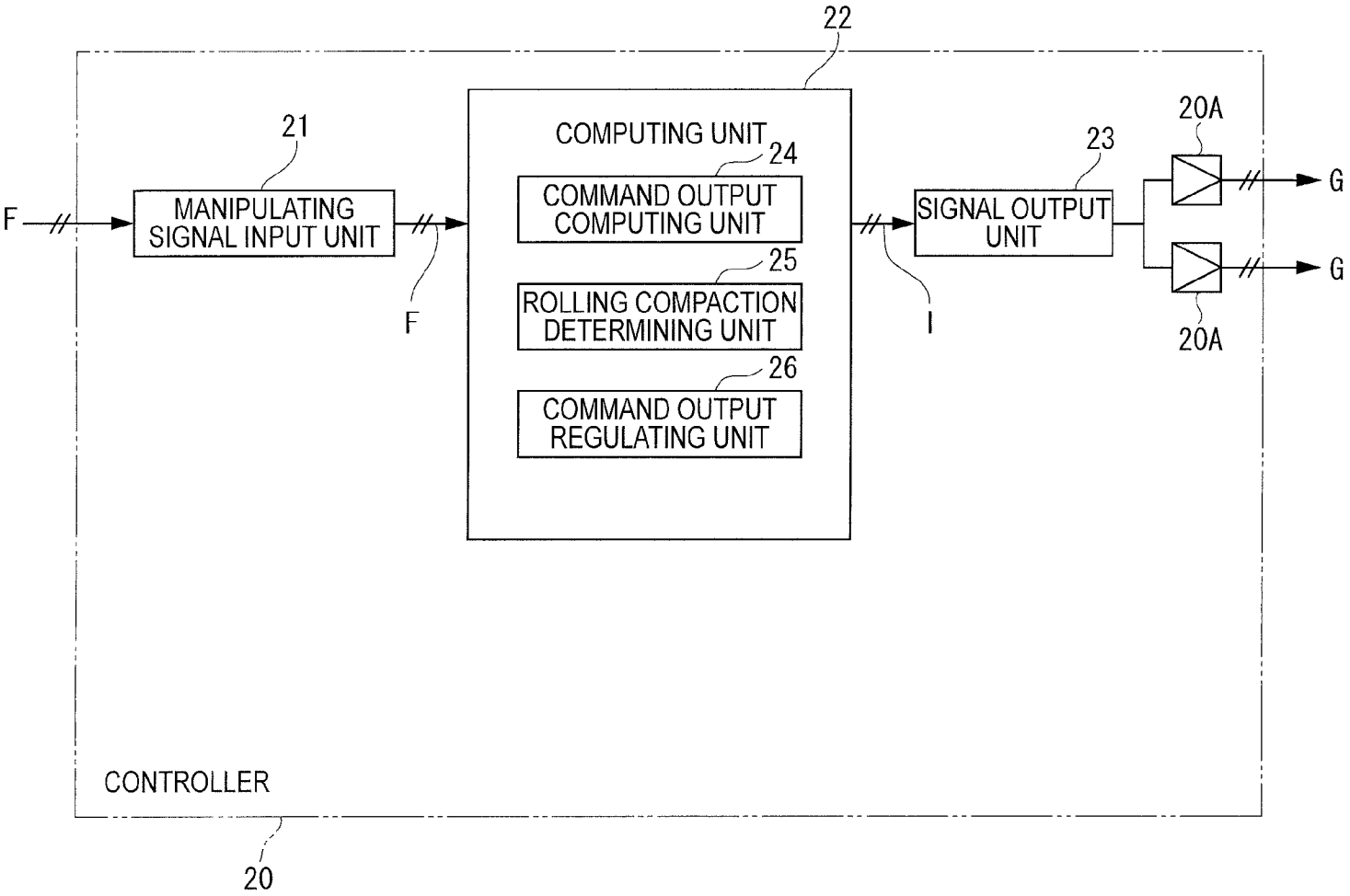
FIG. 2 is a block diagram showing the controller.

FIG. 1 is a schematic diagram showing a hydraulic excavator (construction machine) 1 on which a working equipment and a controller thereof are installed according to a first exemplary embodiment of the invention. FIG. 2 is a block diagram showing the controller.

In FIG. 1, the hydraulic excavator 1 includes a boom 11 manipulated by a working equipment lever (manipulating unit) 2 as an electric lever, an arm 12 manipulated by another working equipment lever (not shown), and a bucket 13 attached to a tip of the arm 12.

The boom 11 is rotated around a support point D1 by a hydraulic cylinder 14.

The arm 12 is rotated around a support point D2 by a hydraulic cylinder on the boom 11.

The bucket 13 is rotated by the hydraulic cylinder on the arm 12 when the working equipment lever 2 is manipulated in different directions. The boom 11, the arm 12 and the bucket 13 provide a working equipment 10 according to this exemplary embodiment.

In this exemplary embodiment, the detailed description of the invention is made with reference to the boom 11 as a representative. Drawings and descriptions of driving devices such as the working equipment lever for manipulating the arm 12, a hydraulic cylinder for moving the arm 12 and the bucket 13 respectively, and a main valve, and the controller for controlling the driving devices will be omitted.

The hydraulic cylinder 14 is hydraulically driven by hydraulic fluid fed via a main valve 16 after being discharged from a hydraulic pump 15. A spool 16A of the main valve 16 is moved by EPC valves 17 as a pair of proportional solenoid valves, whereby a feed flow rate of the hydraulic fluid to the hydraulic cylinder 14 is adjusted.

The working equipment lever 2 is provided with an inclination angle detector such as a potentiometer, a proportional pressure control (PPC) pressure sensor or a torque sensor with use of an electrostatic capacity or a laser. A lever manipulating signal F having a one-to-one relationship with an inclination angle of the working equipment lever 2 is outputted from the inclination angle detector to the controller 20.

When the working equipment lever 2 is at a neutral position, the outputted lever manipulating signal F is "0 (zero)," indicating that a speed of the boom 11 is "0 (zero)." When the working equipment lever 2 is inclined forward, the boom 11 moves downward at a speed corresponding to the inclination angle of the working equipment lever 2. When the working equipment lever 2 is inclined backward relative to the working equipment 10, the boom 11 moves upward at a speed corresponding to the inclination angle of the working equipment lever 2. The controls as described above are provided by the controller 20 described hereinafter.

The controller 20 has a function to control a motion of the boom 11 based on the lever manipulating signal F from the working equipment lever 2. The controller 20 is provided by a microcomputer and the like, and is typically incorporated as a portion of a governor pump controller mounted for controlling an engine of the hydraulic excavator 1 and for controlling a hydraulic pump thereof. However, in this exemplary embodiment, the controller 20 is shown as an independent component for convenience of descriptions.

(2) Structure of Controller 20

Specifically, as shown in FIG. 2, the controller 20 includes a manipulating signal input unit (manipulation information acquiring unit) 21, a computing unit 22 and a signal output unit 23.

(2-1) Structure of Manipulating Signal Input Unit 21

The manipulating signal input unit 21 receives the lever manipulating signal (manipulation information) F from the working equipment lever 2, converts the inputted lever manipulating signal F to a signal readable by the computing unit 22, and outputs the converted lever manipulating signal F.

Hereinafter, a signal outputted from the manipulating signal input unit 21 will be also described as the lever manipulating signal F for convenience of descriptions.

(2-2) Structure of Computing Unit 22

The computing unit 22 includes a command output computing unit 24 provided by computer programs (software), a rolling compaction determining unit 25 and a command output regulating unit 26.

The command output computing unit 24 computes a command output value I to be outputted to the EPC valves 17 based on the lever manipulating signal F inputted via the manipulating signal input unit 21 in order to move the boom 11 at a speed corresponding to the inclination angle of the working equipment lever 2.

The rolling compaction determining unit 25 determines whether or not the boom 11 is under the rolling compaction operation based on the inputted lever manipulating signal F.

Determination processing of the rolling compaction operation will be described below.

When the rolling compaction determining unit 25 determines that the boom 11 is under the rolling compaction operation, the command output regulating unit 26 regulates the command output value I so that the command output value I computed by the command output computing unit 24 does not exceed a predetermined maximum value Imax (command output regulation processing).

In this exemplary embodiment, the maximum value Imax is set to be approximately one-third of the command output value I obtained when the working equipment lever 2 is inclined at a maximum mechanical inclination angle.

(2-3) Structure of Signal Output Unit 23

The signal output unit 23 has a function to generate a command signal (current signal) G for the EPC valves 17 based on the command output value I which is computed by the command output computing unit 24 and applied with the command output regulation processing by the command output regulating unit 26, and to output the command signal G via amplifiers 20A to the EPC valves 17. The EPC valves 17 moves the spool 16A constituting the main valve 16 based on the command signal G, and adjusts a feed rate of the hydraulic fluid to the hydraulic cylinder 14.

(3) Operation of Controller 20

Figure 3:
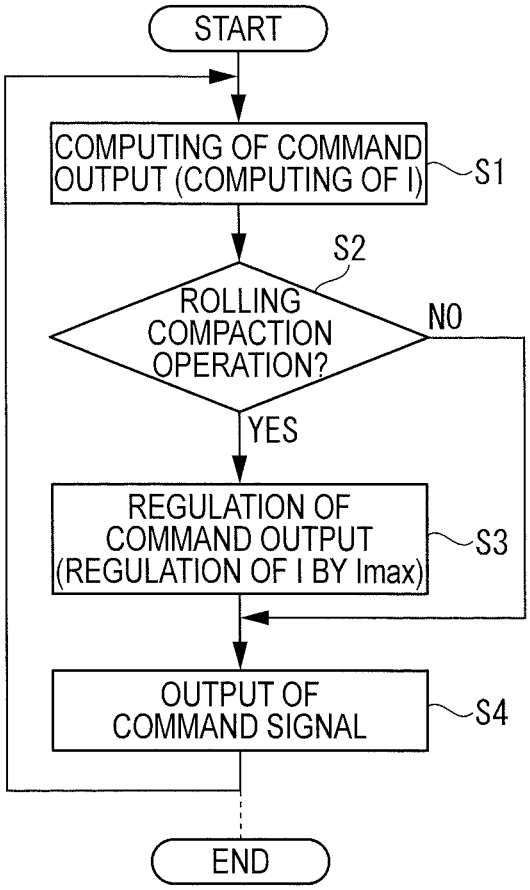
FIG. 3 is a flow chart for explaining a method for controlling the working equipment.

Next, a method for controlling the boom 11 will be described with reference to a flow chart in FIG. 3, and also the above-described rolling compaction determining unit 25 and the command output regulating unit 26 will be described in detail with reference to FIGS. 4, 6A and 6B.

(a) Step S1: At first, when an operator starts manipulation of the working equipment lever 2, the command output computing unit 24 computes the command output value I based on the lever manipulating signal F inputted from the working equipment lever 2 via the manipulating signal input unit 21.

(b) Step S2: Next, the rolling compaction determining unit 25 determines whether or not the boom 11 is under the rolling compaction operation based on the inputted lever manipulating signal F.

Figure 4:
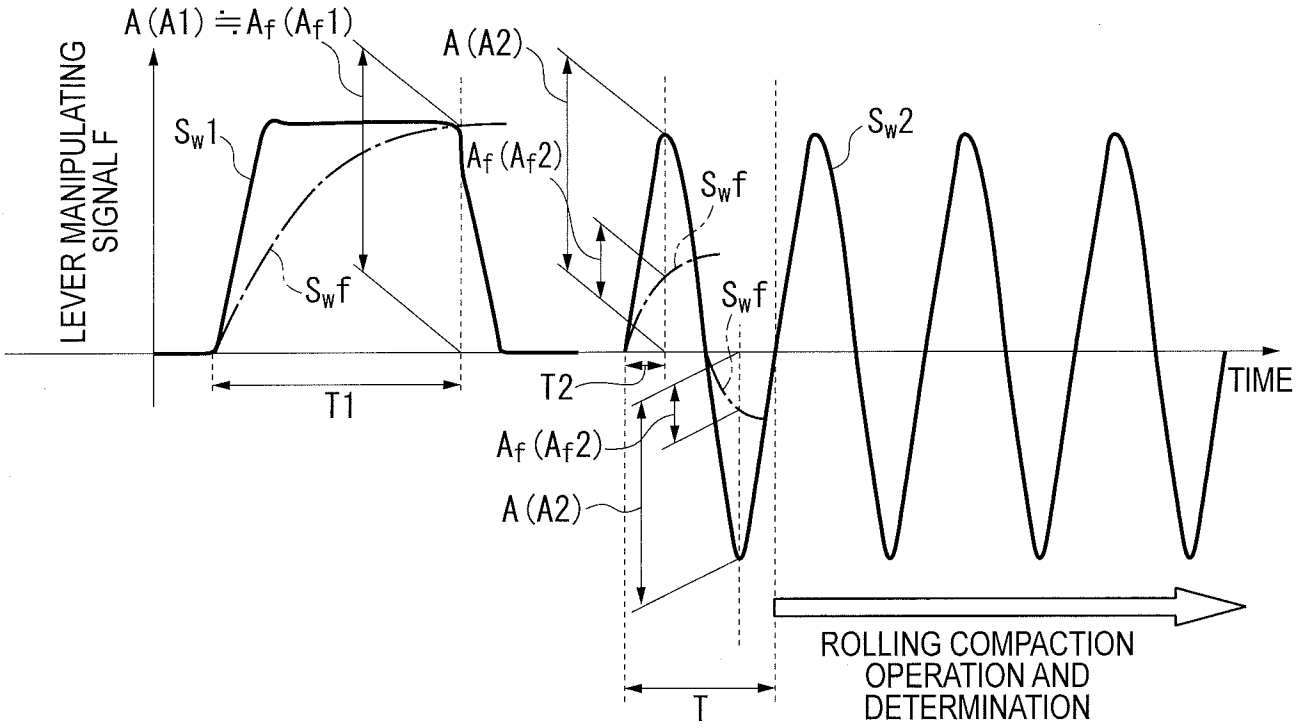
FIG. 4 is an illustration showing an example of determination processing of a rolling compaction operation.

FIG. 4 is an illustration showing an example of determination processing of a rolling compaction operation.

In FIG. 4, the vertical axis represents the inputted lever manipulating signal F (voltage value) and the horizontal axis represents time.

In FIG. 4, a signal waveform $S_w$1 is a signal waveform of the lever manipulating signal F formed by inclining the working equipment lever 2 forward, keeping the working equipment lever 2 inclined for a predetermined time, and then returning the working equipment lever 2 to the neutral position.

In FIG. 4, a signal waveform $S_w$2 is a signal waveform of the lever manipulating signal F formed by reciprocating the working equipment lever 2 forward and backward (a rolling compaction operation) over the neutral position in a short cycle. In other words, the signal waveform $S_w$2 is a signal waveform of the lever manipulating signal F when the boom 11 is under the rolling compaction operation.

Moreover, in FIG. 4, a waveform $S_w$f shown by a chain line is a signal waveform of the lever manipulating signal F after a filter processing in which a low-pass filter is applied to the lever manipulating signal F.

It can be determined whether or not the boom 11 is under the rolling compaction operation by, for instance, distinguishing the signal waveforms $S_w$1 and $S_w$2 as follows.

Specifically, when the signal waveform of the lever manipulating signal F is shown by $S_w$1, as shown in FIG. 4, time T1 before returning the working equipment lever 2 to the neutral position (i.e., shifting to speed reduction) after inclining the working equipment lever 2 is long. Accordingly, at the time of shifting to speed reduction, an input peak value A(A1) of the lever manipulating signal F and a peak value $A_f$($A_f$1) after the filter processing in which a low-pass filter is applied to the lever manipulating signal F become approximately equal.

On the other hand, when the signal waveform of the lever manipulating signal F is shown by $S_w$2, as shown in FIG. 4, time T2 before returning the working equipment lever 2 to the neutral position after inclining the working equipment lever 2 away from the neutral position is short. Accordingly, at the time of shifting to speed reduction, an input peak value A(A2) of the lever manipulating signal F is significantly different from a peak value $A_f$($A_f$2) after the filter processing in which a low-pass filter is applied to the lever manipulating signal F.

For this reason, by comparing the input peak value A with the peak value $A_f$ after the filter processing in which low-pass filter is applied, for instance, when the peak value $A_f$ is less than a predetermined ratio relative to the input peak value A, the lever manipulating signal F is determined to be the signal waveform $S_w$2, not the signal waveform $S_w$1.

However, this determination method is only for measuring a length of time before shifting to speed reduction after the working equipment lever 2 is inclined away from the neutral position. In other words, it cannot be determined only by this determination method whether the operator has performed an inching operation to move the working equipment lever for a short time in one direction (e.g., in a boom-down direction), or a rolling compaction operation to alternately shift the working equipment lever in reciprocating directions (e.g., in a boom-down direction and a boom-up direction).

As shown in FIG. 4, when a value of the lever manipulating signal F is inverted to be a negative number immediately after the value represents a positive number, and when the peak value $A_f$ is continuously less than a predetermined ratio relative to the input peak value A as described above, the boom 11 is determined to be under the rolling compaction operation.

In this exemplary embodiment, the rolling compaction determining unit 25 includes a low-pass filter for applying the above-described filter processing to the inputted lever manipulating signal F. As described above, when a value of the lever manipulating signal F is inverted to be a negative number immediately after the value represents a positive number, by determining whether or not the peak value $A_f$ is continuously less than a predetermined ratio (e.g., 50%) relative to the input peak value A, the rolling compaction determining unit 25 determines whether the boom 11 is under the rolling compaction operation.

Whether or not the boom 11 is under the rolling compaction operation can be determined not only by the above-described processing but also the following processing.

For a typical rolling compaction operation, the operator reciprocates the working equipment lever 2 forward and backward over the neutral position in a cycle of "approximately 1 to 2 seconds."

Accordingly, for determination processing of the rolling compaction operation, the rolling compaction determining unit 25 may determine whether the boom 11 is under the rolling compaction operation by determining whether or not a cycle T of the lever manipulating signal F (FIG. 4) is, for instance, 2 seconds or less.

When the boom 11 is determined to be not under the rolling compaction operation in Step S2, the command output regulation processing by the command output regulating unit 26 is skipped to proceed to Step S4. In Step S4, the command signal G based on the command output value I computed in Step S1 is outputted to the EPC valves 17.

Figure 5:
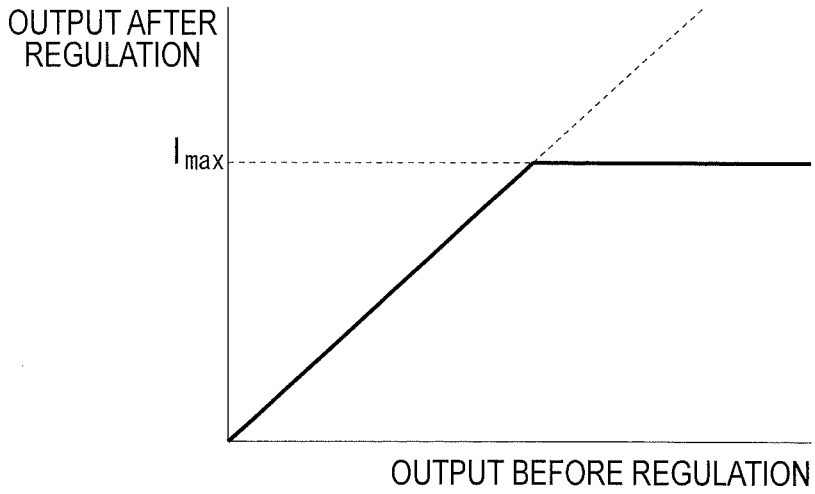
FIG. 5 is an illustration for explaining command output regulation processing.
Figure 6A:
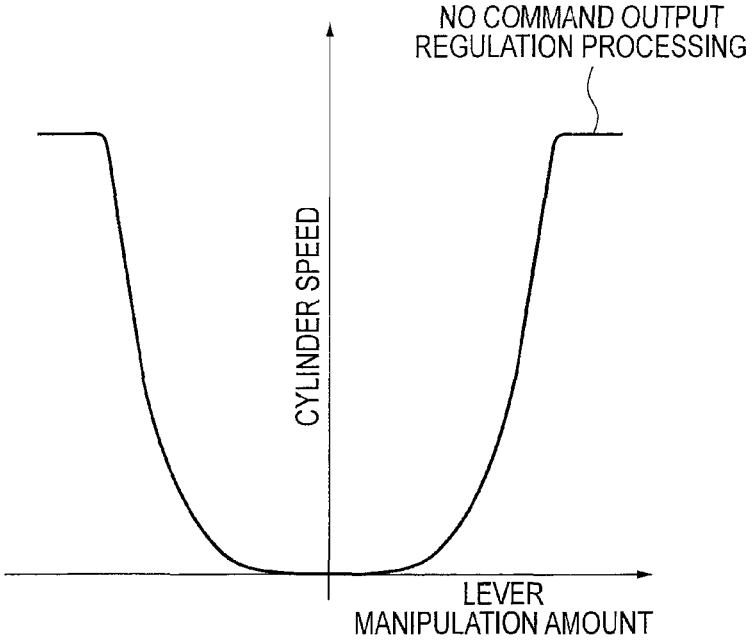
FIG. 6A is another illustration for explaining the command output regulation processing.
Figure 6B:
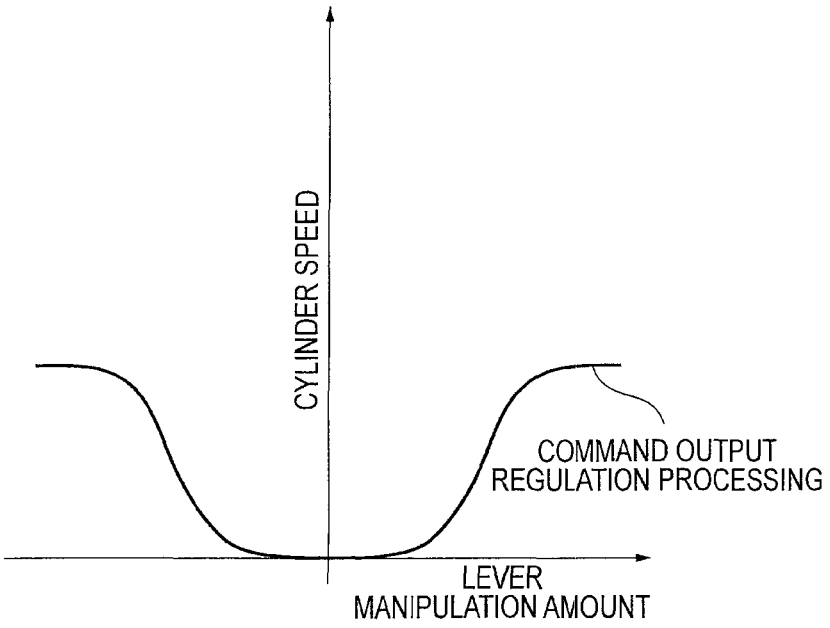
FIG. 6B is still another illustration for explaining the command output regulation processing.

FIGS. 5, 6A and 6B are illustrations for explaining the command output regulation processing.

In FIG. 5, the horizontal axis represents a command output value I before the command output regulation processing and the vertical axis represents a command output value I after the command output regulation processing.

In FIGS. 6A and 6B. the vertical axis represents an actual motion speed of the hydraulic cylinder 14 (a cylinder speed) and the horizontal axis represents a manipulation amount of the working equipment lever 2 (a lever manipulating signal F). FIG. 6A shows a case where the command output regulation processing is not performed when the boom 11 is under the rolling compaction operation. FIG. 6B shows a case where the command output regulation processing is performed when the boom 11 is under the rolling compaction operation.

(c) Step S3: When the boom 11 is determined to be under the rolling compaction operation in Step S2, the command output regulating unit 26 performs the command output regulation processing to the command output value I computed in Step S1 with the maximum value Imax as shown in FIG. 5. Subsequently, the command output regulating unit 26 outputs the command output value I after applying the command output regulation processing to the signal output unit 23.

(d) Step S4: The signal output unit 23 converts the command output value I, which is computed in Step S1 and treated with the command output regulation processing in Step S3, to the command signal G and outputs the command signal G to the EPC valves 17.

With the above processing, the pilot pressure from the EPC valves 17 moves the spool 16A of the main valve 16, so that hydraulic pressure of the main valve 16 moves the boom 11 at a predetermined speed.

For instance, when the command output regulating unit 26 does not perform the command output regulation processing, the hydraulic cylinder 14 drives the boom 11 based on the command output value I in accordance with the lever manipulating signal F (the command output value I computed in Step S1). Accordingly, as shown in FIG. 6A, when the manipulation amount of the working equipment lever 2 is large, the hydraulic cylinder 14 drives the boom 11 based on a relatively high command output value I in accordance with the manipulation amount of the working equipment lever 2, so that the boom 11 moves at a high speed.

On the other hand, when the command output regulating unit 26 performs the command output regulation processing, a relatively high command output value I is regulated at the maximum value Imax as shown in FIG. 5. Accordingly, as shown in 6B, when the manipulation amount of the working equipment lever 2 is large, the hydraulic cylinder 14 drives the boom 11 based on the maximum value Imax, so that the boom 11 moves at a low speed.

When the command output value I is smaller than the maximum value Imax, the command output value I is not regulated at the command output value I as shown in FIG. 5. Accordingly, as shown in FIG. 6B, when the manipulation amount of the working equipment lever 2 is small, the boom 11 moves at a speed equivalent to the speed when the command output regulation processing is not performed (FIG. 6A).

(4) Advantages of Exemplary Embodiment

According to this exemplary embodiment, the following advantages are provided.

The controller 20 installed on the hydraulic excavator 1 includes the rolling compaction determining unit 25 and the command output regulating unit 26. With this arrangement, when the working equipment 10 is under the rolling compaction operation, the motion speed of the boom 11 can be regulated so as not to exceed a predetermined maximum value.

In other words, even when the operator carelessly increases the inclination angle of the working equipment lever 2, the motion speed of the boom 11 is regulated, so that a vehicle body does not swing heavily. Accordingly, it is not required to carefully manipulate the working equipment lever 2, thereby improving operability of the working equipment 10.

On the other hand, when operations other than the rolling compaction operation are performed, the motion speed of the boom 11 is not regulated. Accordingly, the operator can quickly move the boom 11 at a speed in accordance with the inclination angle of the working equipment lever 2.

In other words, in the rolling compaction operation, a maximum motion speed of the boom 11 (a motion speed of the boom 11 when the working equipment lever 2 is inclined at the maximum inclination angle) is reduced. In other operations, the maximum motion speed of the boom 11 is increased. With this arrangement, the maximum motion speed of the boom 11 is changeable in accordance with motion conditions of the working equipment 10. Accordingly, without deteriorating operability during operations other than the rolling compaction operation, operability under the rolling compaction operation is improvable.

The rolling compaction determining unit 25 performs determination processing of the rolling compaction operation based on the inputted lever manipulating signal F. Here, the rolling compaction determining unit 25 automatically determines whether or not the working equipment 10 is under the rolling compaction operation. With this automatic determination, an additional structure (e.g., a switch manipulated by the operator) for allowing the controller 20 to recognize that the working equipment is under a rolling compaction operation is not required, thereby simplifying the structure of the hydraulic excavator 1.

In addition, since the rolling compaction determining unit 25 and the command output regulating unit 26, which are the most characteristic features in this exemplary embodiment, are provided by software, the rolling compaction determining unit 25 and the command output regulating unit 26 can be easily installed in the controller 20 of the existing hydraulic excavator 1.

Second Exemplary Embodiment

Next, a second exemplary embodiment of the invention will be described below. In the following description, the same components as those described above will be indicated by the same reference numerals and the description thereof will be omitted.

The controller 20 according to the first exemplary embodiment uses a predetermined maximum value Imax (e.g., approximately one-third of the command output value I at the maximum inclination angle) for a command output regulation processing.

In contrast, a controller 20*a* according to the second exemplary embodiment is different from the controller 20 according to the first exemplary embodiment in that the controller 20*a* changes the maximum value Imax based on the cycle T of the lever manipulating signal F and performs the command output regulation processing with use of the changed maximum value Imax.

(1) Structure of Command Output Regulating Unit 26*a*

Figure 7:
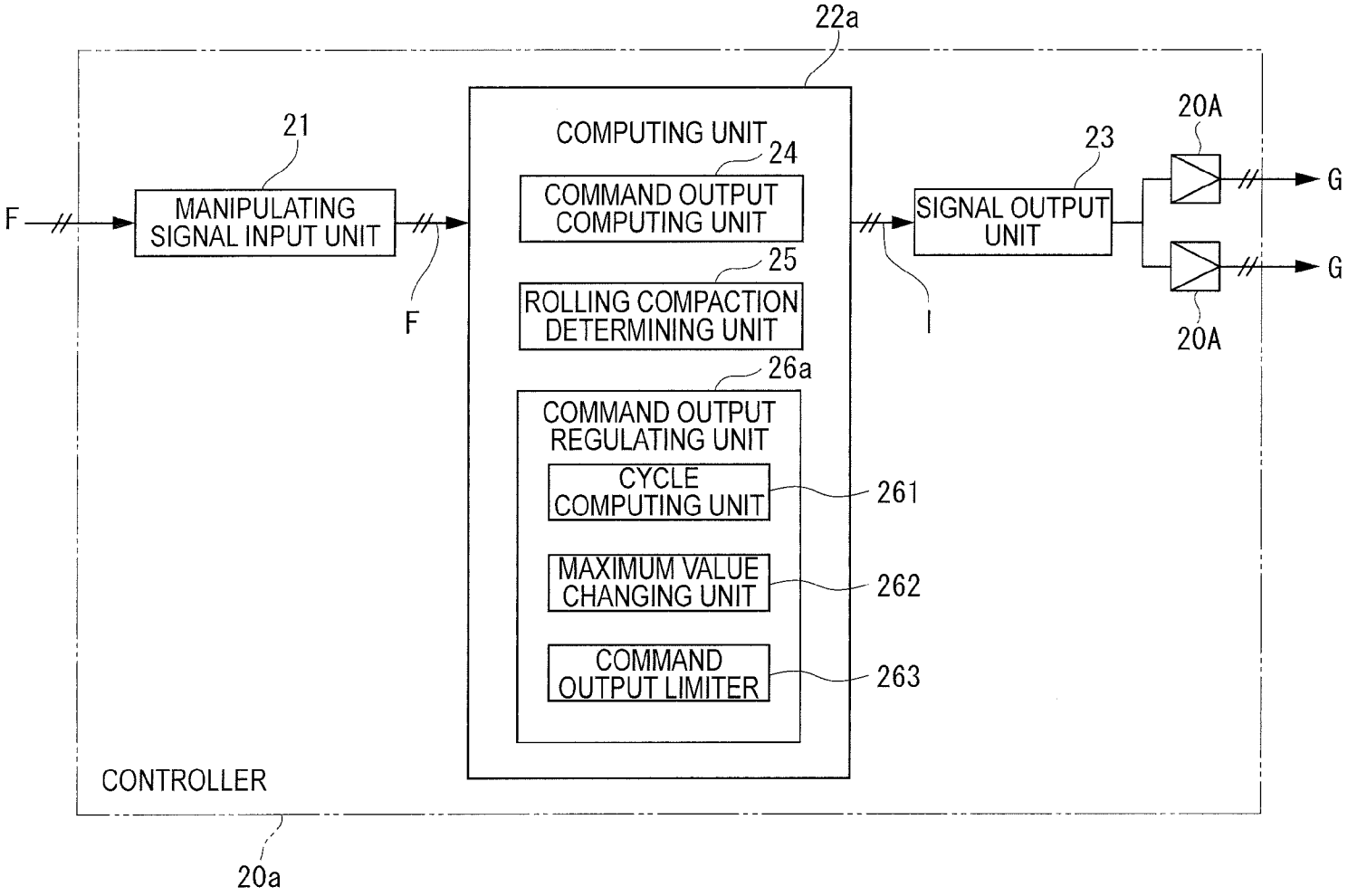
FIG. 7 is a block diagram showing a controller according to a second exemplary embodiment of the invention.

FIG. 7 is a block diagram showing the controller 20*a* according to the second exemplary embodiment of the invention.

Specifically, as shown in FIG. 7, a command output regulating unit 26*a* constituting a computing unit 22*a* of the controller 20*a* according to the second exemplary embodiment includes a cycle computing unit 261, a maximum value changing unit 262 and a command output limiter 263.

The cycle computing unit 261 computes the time required for a sequence of actions (the cycle T of the lever manipulating signal F (see FIG. 4)) including: based on the inputted lever manipulating signal F, inclining the working equipment lever 2 from the neutral position (the lever manipulating signal F is "0" (zero)); returning to the neutral position; inclining the working equipment lever 2 in an opposite direction from the previous inclined direction; and again returning to the neutral position.

The maximum value changing unit 262 sets the maximum value Imax for the command output limiter 263 to be a maximum value in accordance with the cycle T based on the cycle T of the lever manipulating signal F.

The command output limiter 263 regulates the command output value I with use of the maximum value Imax set by the maximum value changing unit 262 so that the command output value I computed by the command output computing unit 24 does not exceed the maximum value Imax set by the maximum value changing unit 262.

(2) Operation of Controller 20*a*

Next, a method for controlling the boom 11 will be described with reference to a flow chart in FIG. 8.

The method for controlling the boom 11 according to this exemplary embodiment is different from the controlling method described in the first exemplary embodiment only in the command output regulation processing (Step S3). Accordingly, only the command output regulation processing will be described below.

Figure 9A:
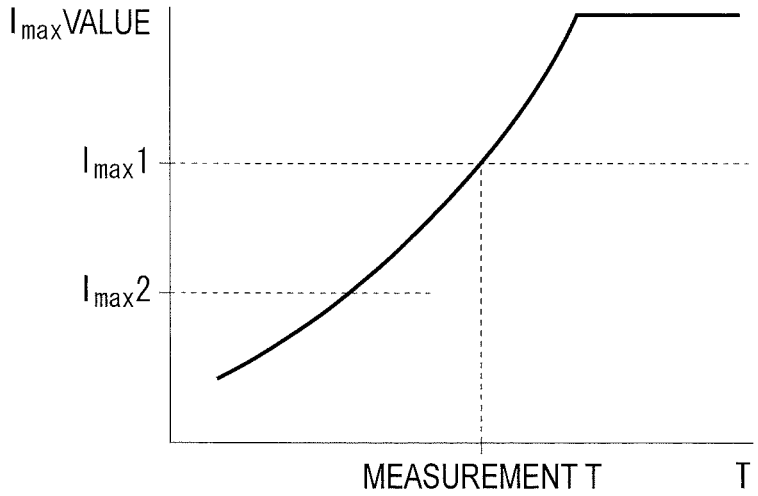
FIG. 9A is an illustration for explaining the setting of a maximum value.
Figure 9B:
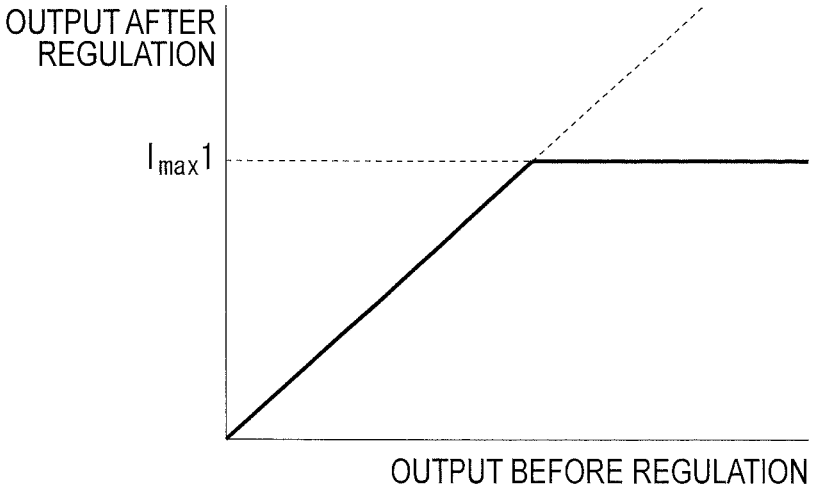
FIG. 9B is an illustration for explaining command output regulation processing.

FIG. 9A is an illustration for explaining setting of the maximum value. FIG. 9B is an illustration for explaining the command output regulation processing.

In FIG. 9A, the horizontal axis represents the cycle T and the vertical axis represents the maximum value Imax. In FIG. 9B, the vertical axis and the horizontal axis represent the same as those in FIG. 5.

(a) Step S3A: The cycle computing unit 261 computes the cycle T of the lever manipulating signal F based on the inputted lever manipulating signal F.

(b) Step S3B: Next, as shown in FIG. 9A, the maximum value changing unit 262 sets the maximum value Imax based on the cycle T.

(c) Step S3C: Next, as shown in FIG. 9B, the command output limiter 263 regulates the command output value I with use of the maximum value Imax set in Step S3B so that the command output value I computed in Step S1 does not exceed the maximum value Imax.

Figure 10A:
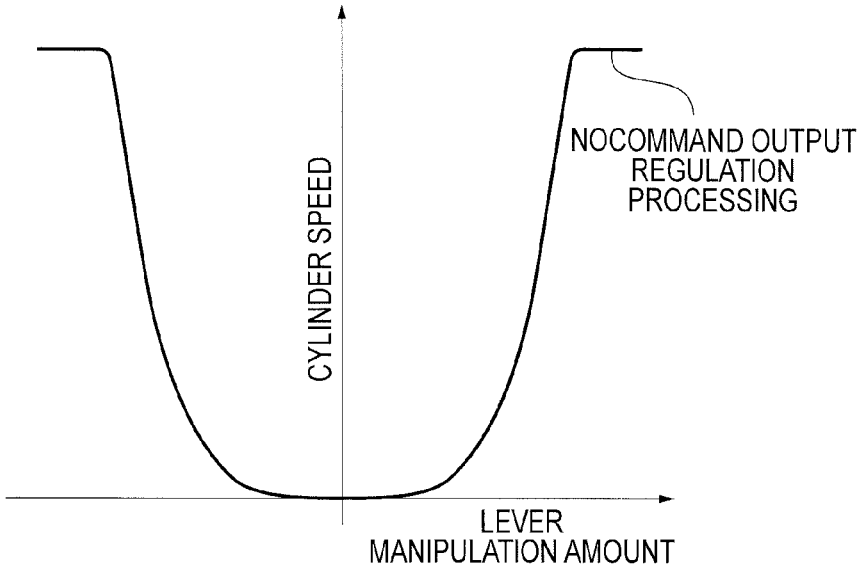
FIG. 10A is an illustration for explaining the command output regulation processing.
Figure 10B:
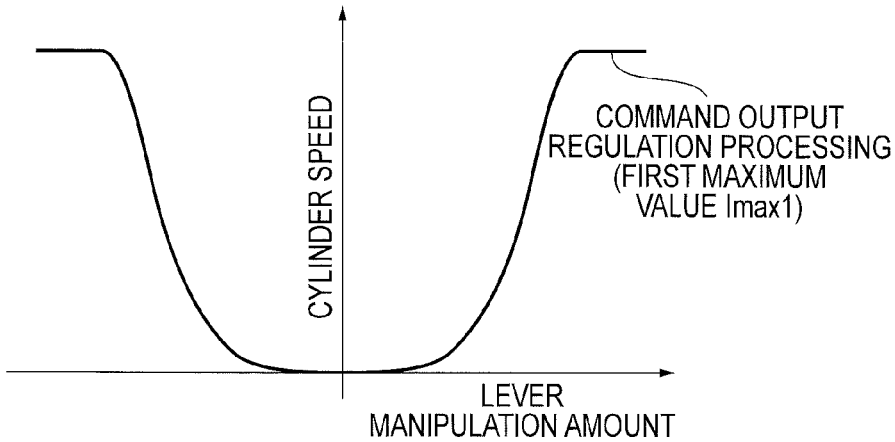
FIG. 10B is another illustration for explaining the command output regulation processing.
Figure 10C:
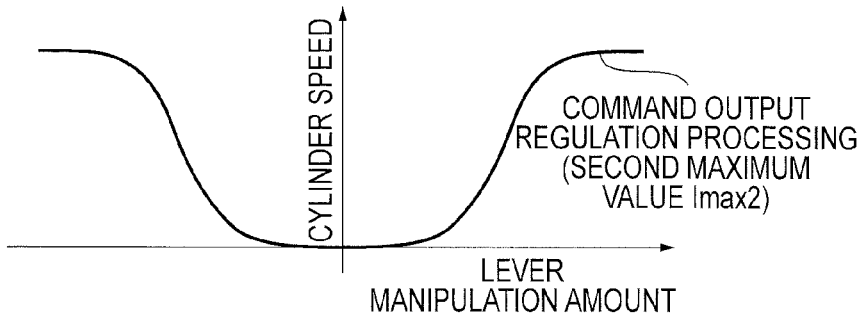
FIG. 10C is still another illustration for explaining command output regulation processing.

FIGS. 10A, 10B and 10C are illustrations for explaining the command output regulation processing.

In FIGS. 10A, 10B and 10C, the vertical axis and the horizontal axis represent the same as those in FIGS. 6A and 6B.

FIG. 10A shows a case where the command output regulation processing is not performed when the boom 11 is under the rolling compaction operation. FIG. 10B shows a case where the command output regulation processing is performed with use of a first maximum value Imax1. FIG. 10C shows a case where the command output regulation processing is performed with use of a second maximum value Imax2.

In this exemplary embodiment, the second maximum value Imax2 is the same value as that of the maximum value Imax described in the first exemplary embodiment (e.g., the value of approximately one-third of the command output value I obtained when the working equipment lever 2 is inclined at the maximum inclination angle). In short, FIGS. 10A and 10C are the same as FIGS. 6A and 6B.

As described above, when the cycle T is represented by a large value, the command output regulating unit 26*a* regulates the command output value I by the first maximum value Imax1. In other words, when the cycle of the reciprocating operation over the neutral position of the working equipment lever 2 by the operator is represented by the large value, the command output value I is moderately regulated by the first maximum value Imax1. Accordingly, as shown in FIG. 10B, when the manipulation amount of the working equipment lever 2 is large, the boom 11 moves at a speed that is lower than that when the command output regulation processing is not performed (FIG. 10A) and is higher than that when the command output regulation processing is performed with use of the second maximum value Imax2 (FIG. 10C). Consequently, unlike the first exemplary embodiment where the maximum value is fixed at Imax2, the boom 11 can move at a higher speed in a longer cycle.

(3) Advantages of Exemplary Embodiment

In addition to the advantages described in the first exemplary embodiment, the following advantages are provided by the second exemplary embodiment.

The command output regulating unit 26*a* constituting the controller 20*a* includes the cycle computing unit 261, the maximum value changing unit 262 and the command output limiter 263. With this arrangement, the cycle of the reciprocating operation of the working equipment lever 2 by the operator can be changed. In other words, the maximum value for regulating the motion speed of the boom 11 in accordance with the manipulation of the working equipment lever 2 can be changed based on the cycle T of the lever manipulating signal F.

Specifically, when the operator reciprocates the working equipment lever 2 in a relatively long cycle for the rolling compaction operation, the maximum motion speed of the boom 11 is set at a value larger than that in the first exemplary embodiment, thereby quickly moving the boom 11 to beat the ground hard with the bucket 13 although the vehicle body slightly swings.

Moreover, when the operator reciprocates the working equipment lever 2 in a relatively short cycle for the rolling compaction operation, the maximum motion speed of the boom 11 is set at the same value as that in the first exemplary embodiment, thereby rhythmically moving the boom 11 (the bucket 13) up and down in a predetermined cycle while slowly moving the boom 11 (the bucket 13).

Accordingly, even in the rolling compaction operation, the maximum motion speed of the boom 11 can be changed by the manipulation of the operation, so that a beating force for the rolling compaction can be suitably adjusted depending on usage.

Third Exemplary Embodiment

Next, a third exemplary embodiment of the invention will be described below.

Figure 11:
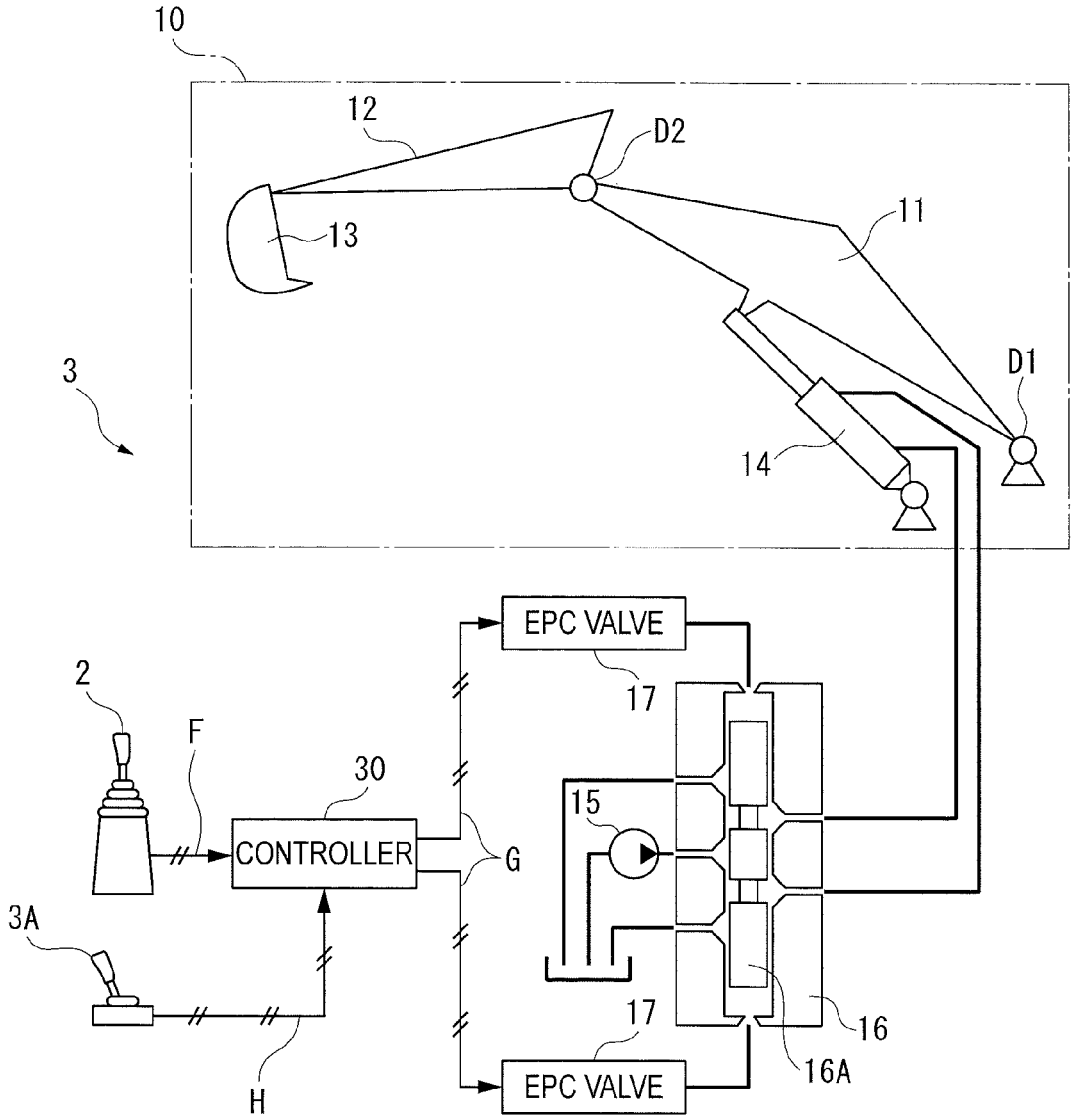
FIG. 11 is a schematic diagram showing a construction machine according to a third exemplary embodiment of the invention.

FIG. 11 is a schematic diagram showing a hydraulic excavator (construction machine) 3 according to the third exemplary embodiment of the invention.

The controller 20 according to the first exemplary embodiment performs determination processing of the rolling compaction based on the inputted lever manipulating signal F.

In contrast, the controller 30 according to the third exemplary embodiment is different from the controller 20 according to the first exemplary embodiment in that the controller 30 performs the determination processing of the rolling compaction based on a switch signal from a manual switch 3A manipulated by an operator (FIG. 11).

(1) Structure of Controller 30

Figure 12:
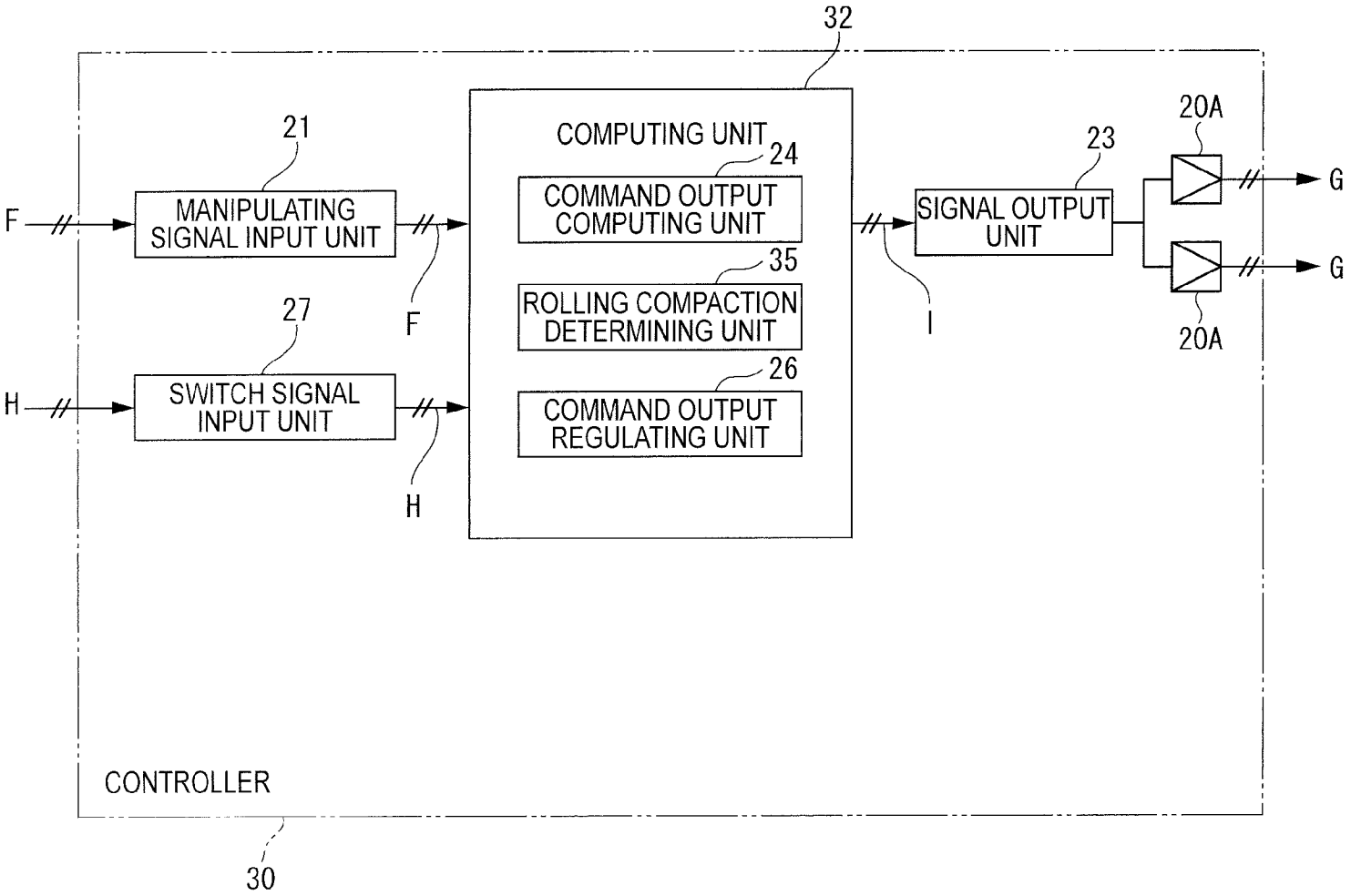
FIG. 12 is a block diagram showing a controller.

FIG. 12 is a block diagram showing the controller 30.

Specifically, as shown in FIG. 12, the controller 30 according to the third exemplary embodiment includes a switch signal input unit 27.

The manual switch 3A outputs an ON signal (a switch signal H) to the controller 30 when the operator turns the manual switch 3A ON for performing the rolling compaction operation. The manual switch 3A outputs an OFF signal (the switch signal H) to the controller 30 when the operator turns the manual switch 3A OFF for performing operations other than the rolling compaction.

The switch signal input unit 27 receives the switch signal H from the manual switch 3A, converts the inputted switch signal H to a signal readable by the computing unit 32, and outputs the converted switch signal H.

Hereinafter, a signal outputted from the switch signal input unit 27 will be also described as the switch signal H for convenience of descriptions.

The rolling compaction determining unit 35 constituting the computing unit 32 of the controller 30 determines whether or not the boom 11 is under the rolling compaction operation based on the inputted switch signal H.

Specifically, the rolling compaction determining unit 35 determines that the boom 11 is under the rolling compaction operation when the inputted switch signal H is an ON signal. The rolling compaction determining unit 35 determines that the boom 11 is during operations other than the rolling compaction operation when the inputted switch signal H is an OFF signal.

The method for controlling the boom 11 according to this exemplary embodiment is different from the controlling method described in the first exemplary embodiment only in that the rolling compaction determining unit 35 determines based on the switch signal H in the determination processing of the rolling compaction (Step S2) as described above. Accordingly, a detailed description will be omitted.

(2) Advantages of Exemplary Embodiment

In addition to the advantages described in the first exemplary embodiment, the following advantages are provided by the second exemplary embodiment.

It can be determined by ON/OFF of the manual switch 3A whether or not the boom 11 is under the rolling compaction operation. Accordingly, even when the operator or working conditions are different, it is not erroneously recognized whether or not the boom 11 is under the rolling compaction operation.

Fourth Exemplary Embodiment

Next, a fourth exemplary embodiment of the invention will be described below.

Figure 13:
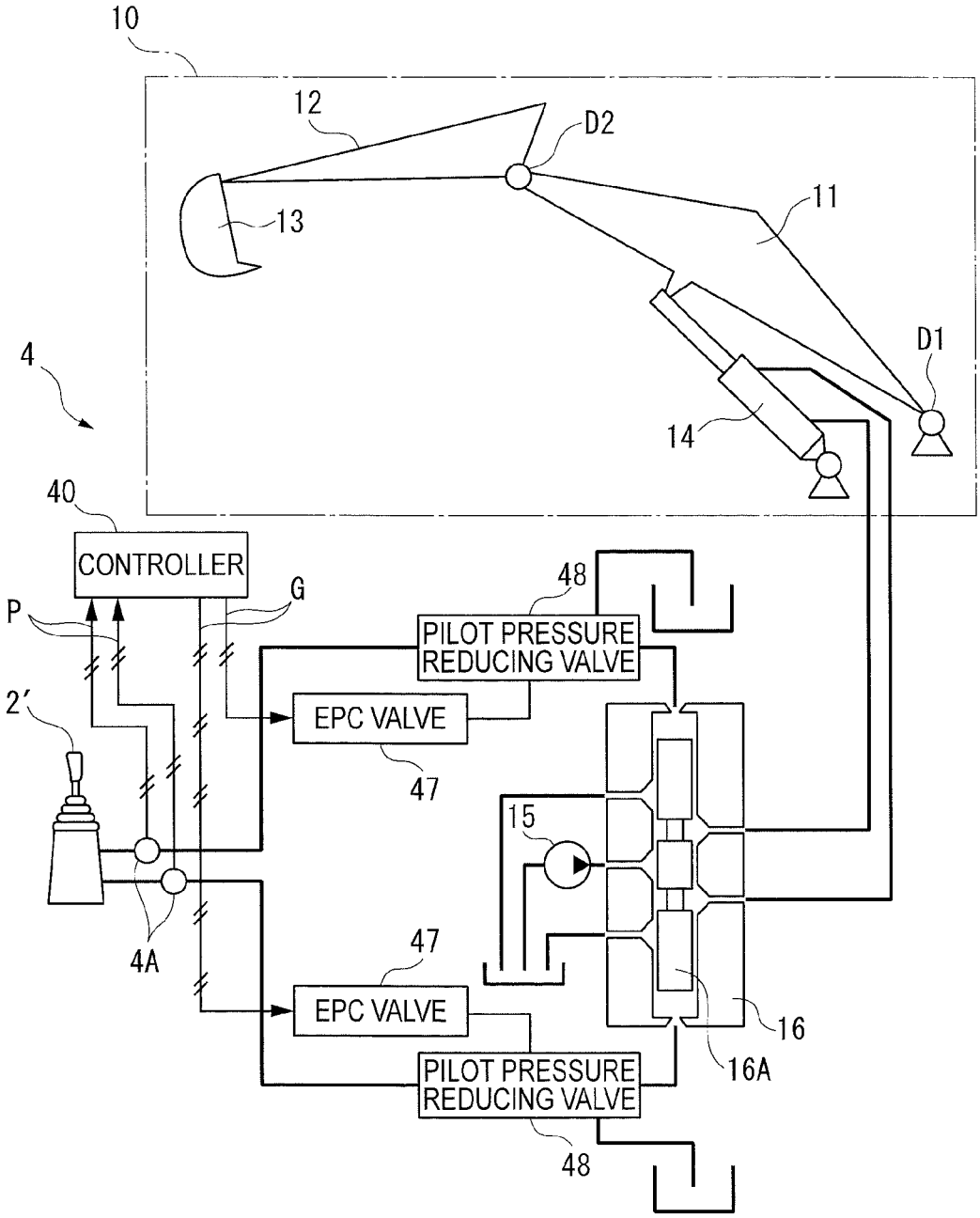
FIG. 13 is a schematic diagram showing a construction machine according to a fourth exemplary embodiment of the invention.

FIG. 13 is a schematic diagram showing a hydraulic excavator (construction machine) 4 according to the fourth exemplary embodiment of the invention.

The hydraulic excavator 1 according to the first exemplary embodiment moves the working equipment 10 (the boom 11) by manipulating the working equipment lever 2 as an electric lever.

In contrast, the hydraulic excavator 4 according to the fourth exemplary embodiment is different from the hydraulic excavator 1 according to the first exemplary embodiment in that the hydraulic excavator 4 according to the fourth exemplary embodiment moves the boom 11 by manipulating the working equipment lever 2' as a hydraulic lever.

Figure 14:
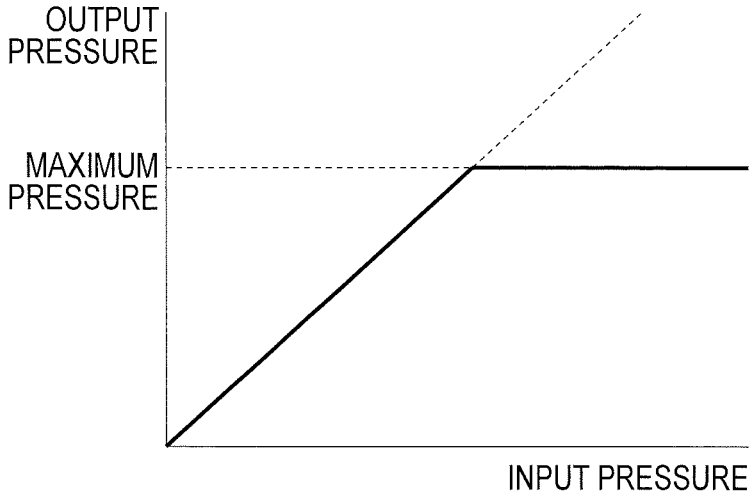
FIG. 14 is an illustration for explaining motion of a pilot pressure reducing valve.

FIG. 14 is an illustration for explaining motion of a pilot pressure reducing valve 48.

Specifically, in this exemplary embodiment, when the working equipment lever 2' (the hydraulic lever) is manipulated as shown in FIG. 13, pressure of pilot pressure oil is reduced, as shown in FIG. 14, to pressure corresponding to the manipulation amount of the working equipment lever 2' by the pilot pressure reducing valve 48 attached to the working equipment lever 2'. The pilot pressure oil representing the manipulation amount of the working equipment lever 2' is fed to an input port corresponding to a lever manipulation direction of input ports of the main valves 16. This pilot pressure oil moves the spool 16A of the main valve 16, whereby the feed flow rate of the hydraulic fluid to the hydraulic cylinder 14 is adjusted.

(1) Structure of Controller 40

Figure 15:
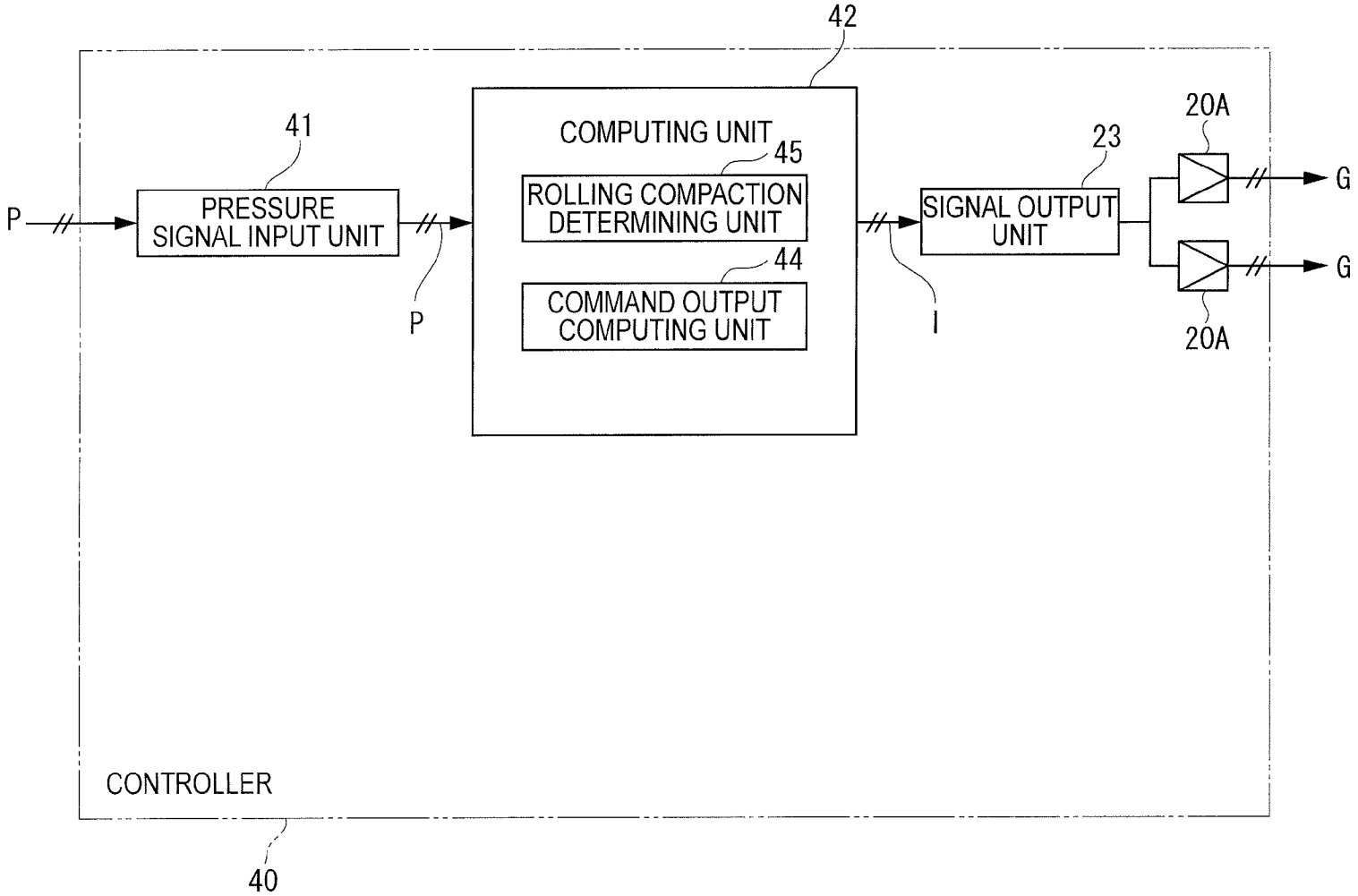
FIG. 15 is a block diagram showing a controller.

FIG. 15 is a block diagram showing the controller 40.

In this exemplary embodiment, since the working equipment lever 2' is provided by a hydraulic lever and the hydraulic cylinder 14 is driven by the hydraulic lever in the same manner as the above, the structure of the controller 40 is also changed as follows.

Specifically, as shown in FIG. 15, the controller 40 includes a pressure signal input unit (manipulation information acquiring unit) 41.

After the manipulation amount of the working equipment lever 2' is detected by a pressure sensor 4A, the pressure signal input unit 41 receives a pressure signal (manipulation information) P outputted from the pressure sensor 4A, converts the inputted pressure signal P to a signal readable by the computing unit 42, and outputs the converted pressure signal P.

Hereinafter, a signal outputted from the pressure signal input unit 41 will be also described as the pressure signal P for convenience of descriptions.

As shown in FIG. 15, the computing unit 42 of the controller 40 includes a rolling compaction determining unit 45 and a command output computing unit 44.

The rolling compaction determining unit 45, which has the same function as the rolling compaction determining unit 25 described in the first exemplary embodiment, determines whether or not the boom 11 is under a rolling compaction operation based on the pressure signal P.

The command output computing unit 44 has a function to compute the command output value I to be outputted to EPC valves 47 for hydraulically controlling the pilot pressure reducing valve 48 based on a determination result by the rolling compaction determining unit 45.

(2) Operation of Controller 40

Figure 16:
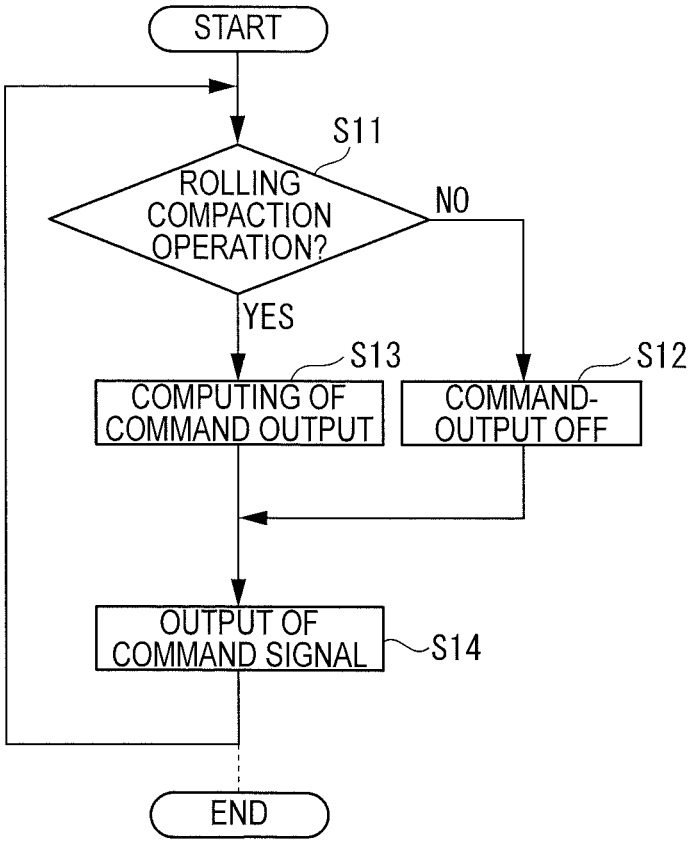
FIG. 16 is a flow chart for explaining a method for controlling a working equipment.

Next, a method for controlling the boom 11 will be described with reference to a flow chart in FIG. 16.

(a) Step S11: At first, when the operator starts manipulation of the working equipment lever 2', the rolling compaction determining unit 45 determines whether or not the boom 11 is under the rolling compaction operation based on the pressure signal P inputted from the pressure sensor 4A via the pressure signal input unit 41.

The determination processing of the rolling compaction by the rolling compaction determining unit 45 is the same determination processing described in the first exemplary embodiment except that the lever manipulating signal F is replaced by the pressure signal P.

(b) Step S12: When the boom 11 is determined to be not under the rolling compaction operation in Step S11, the command output computing unit 44 sets the command output value I to be "OFF (0 (zero))."

Operation is skipped to proceed to Step S14, in which the command signal G based on the command output value I (OFF) is outputted to the EPC valves 47.

By the processing of Steps S12 and S14, the pilot pressure reducing valve 48 transfers the pilot pressure oil outputted from the working equipment lever 2' to the main valves 16 without hydraulic pressure control by the EPC valves 47. Specifically, the spool 16A becomes movable to a maximum mechanical stroke position. In other words, the boom 11 becomes movable at a maximum mechanical motion speed.

(c) Step S13: When the boom 11 is determined to be under the rolling compaction operation in Step S11, the command output computing unit 44 computes a predetermined command output value I.

(d) Step S14: The signal output unit 23 converts the command output value I, which is set in Step S12 and computed in Step S13, to the command signal G and outputs the command signal G to the EPC valves 47.

By the processing of Steps S13 and S14, the pilot pressure reducing valve 48 is hydraulically controlled by the EPC valves 47. With this arrangement, pressure of the pilot pressure oil outputted from the working equipment lever 2' is regulated at pressure not exceeding the maximum pressure set by the pilot pressure reducing valve 48 and is transferred to the main valve 16. Specifically, the spool 16A becomes immovable to the maximum stroke position. In other words, the boom 11 becomes immovable at the maximum motion speed.

More specifically, when the boom 11 is determined to be under the rolling compaction operation, the command output computing unit 44 controls the EPC valves 47 so that the motion speed of the boom 11 does not exceed a predetermined maximum value.

According to the fourth exemplary embodiment, the same action and advantages as those in the above aspect of the invention can be obtained even when the working equipment lever 2' is replaced by the hydraulic lever.

Fifth Exemplary Embodiment

Next, a fifth exemplary embodiment of the invention will be described below.

Figure 17:
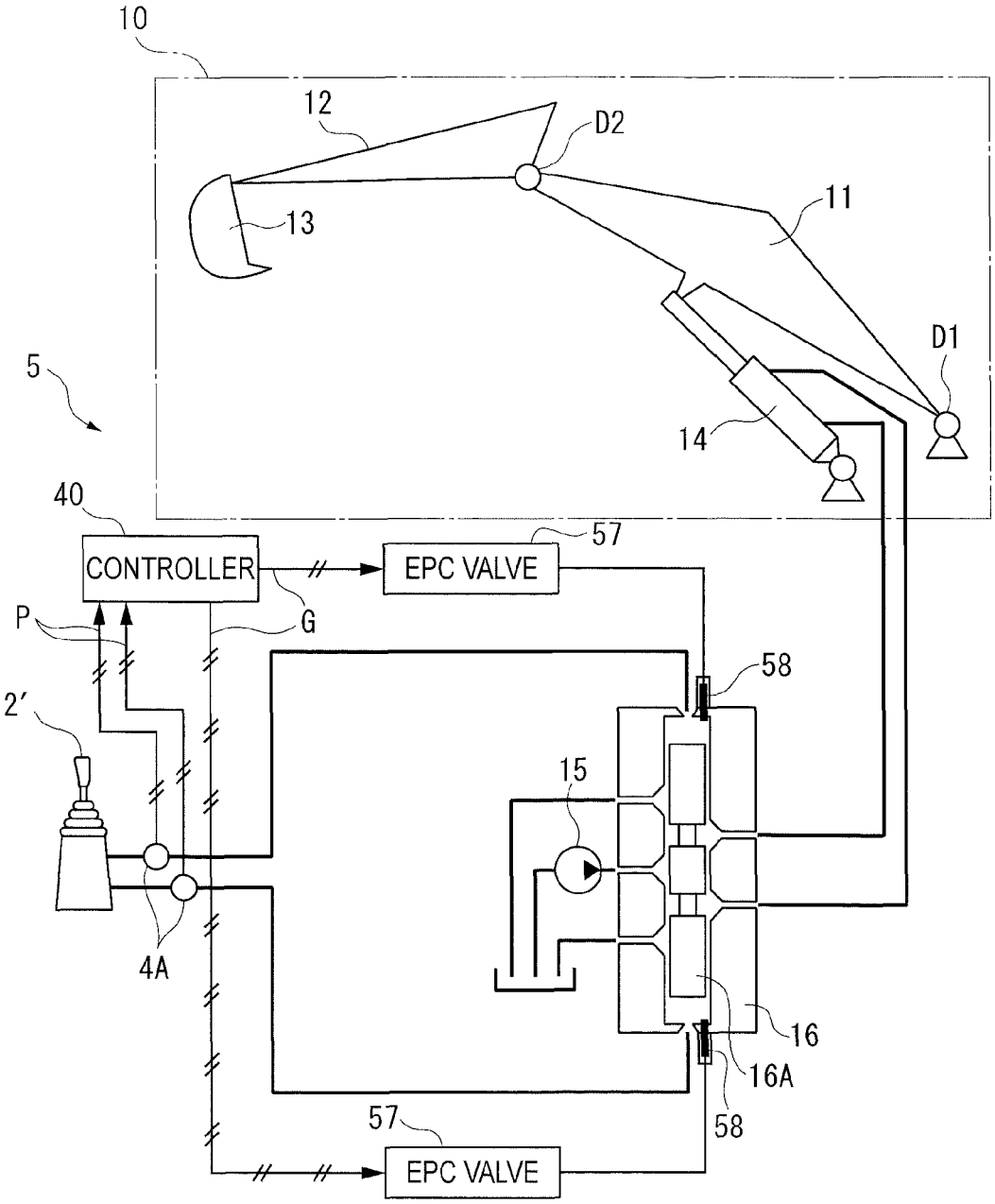
FIG. 17 is a schematic diagram showing a construction machine according to a fifth exemplary embodiment of the invention.
Figure 18A:
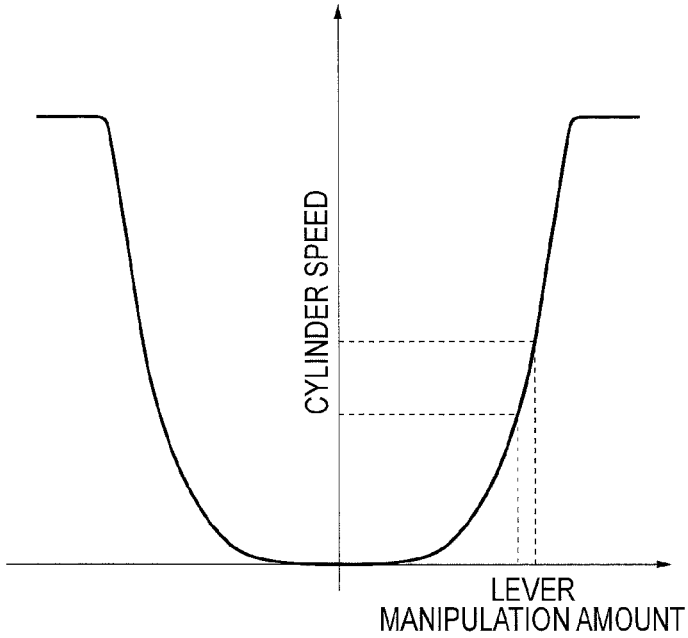
FIG. 18A RELATED ART
FIG. 18A is an illustration for explaining a problem of prior art in a rolling compaction operation.
Figure 18B:
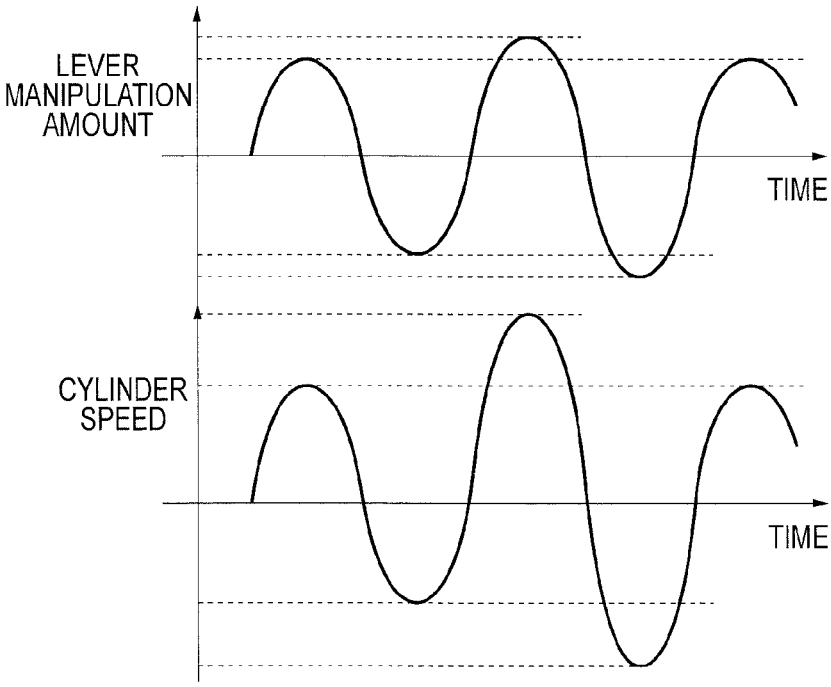
FIG. 18B RELATED ART
FIG. 18B is another illustration for explaining the problem of prior art in the rolling compaction operation.

FIG. 17 is a schematic diagram showing a hydraulic excavator (construction machine) 5 according to the fifth exemplary embodiment of the invention.

In the hydraulic excavator 4 according to the fourth exemplary embodiment, the motion speed of the boom 11 is regulated by the controller 40 controlling the pilot pressure reducing valve 48 via the EPC valves 47.

In contrast, the hydraulic excavator 5 according to the fifth exemplary embodiment is different from the hydraulic excavator 4 according to the fourth exemplary embodiment in that the motion speed of the boom 11 in the hydraulic excavator 5 according to the fifth exemplary embodiment is regulated by the controller 40 controlling a stopper 58 via the EPC valves 57.

The stopper 58 is movable into and out of the main valve 16.

When the controller 40 outputs the command signal G based on a predetermined command output value I and the stopper 58 is hydraulically controlled by the EPC valves 57, the stopper 58 projects into the main valve 16. Then, the stopper 58 is brought into contact with an end of the spool 16A, whereby the spool 16A becomes immovable to the maximum stroke position.

When the controller 40 outputs the command signal G based on the command output value I (OFF) and the stopper 58 is not hydraulically controlled by the EPC valves 57, the stopper 58 moves out of the main valve 16. The stopper 58 is not in contact with the end of the spool 16A, whereby the spool 16A becomes movable to the maximum stroke position.

A structure of the controller 40 and a controlling method of the boom 11 are the same as those in the fourth exemplary embodiment, of which descriptions will be omitted.

According to the fifth exemplary embodiment as described above, the same action and advantages as those in the fourth exemplary embodiment can be obtained even when the motion speed of the boom 11 is regulated by the stopper 58.

The scope of the invention is not limited to the above-described exemplary embodiments, but includes other configurations and the following modifications as long as an object of the invention can be achieved.

Figure 8:
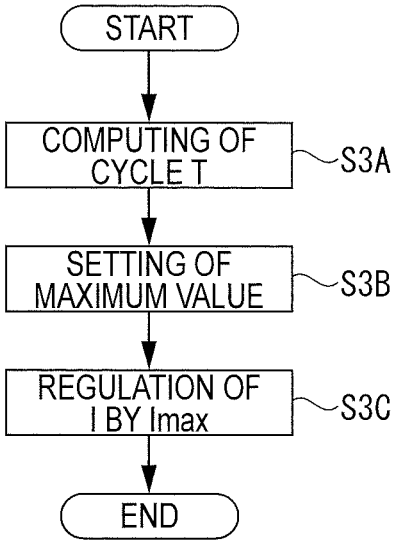
FIG. 8 is a flow chart for explaining a method for controlling a working equipment.

In the second exemplary embodiment, the controller 20 according to the first exemplary embodiment functions to perform command output regulation processing shown in FIG. 8. However, the controllers 30 and 40 respectively according to the third and fifth exemplary embodiments may function to perform command output regulation processing shown in FIG. 8.

In the fourth and fifth exemplary embodiments, the determination processing of the rolling compaction may be performed by ON/OFF of the manual switch 3A in the same manner as in the third exemplary embodiment.

In the first and second exemplary embodiments, the determination processing of the rolling compaction operation is performed based on the lever manipulating signal F. However, the determination processing of the rolling compaction may be performed based on the command output value I computed by the command output computing unit 24 since the command output value I exhibits the same signal waveforms as the lever manipulating signal F. The same description is applied to the command output regulation processing according to the second exemplary embodiment.

Although the best arrangement, method, and the like for carrying out the invention have been described above, the scope of the invention is not limited thereto. In other words, although particular exemplary embodiments of the invention are mainly illustrated and described, a variety of modifications may be made by those skilled in the art on shapes, amounts, and other detailed arrangements of the exemplary embodiments as described above without departing from the spirit and object of the invention.

Thus, a shape, quantity and the like described above merely serve as exemplifying the invention for facilitating an understanding of the invention, and do not serve as any limitations on the invention, so that what is described by a name of a component for which the description of the shape, quantity and the like are partially or totally omitted is also included in the invention.

The invention claimed is:

1. A construction machine comprising:

a working equipment;

a manipulating unit that manipulates the working equipment; and a controller that controls the working equipment, wherein the controller comprises:

a manipulation information acquiring unit that acquires manipulation information on manipulation conditions of the manipulating unit, a rolling compaction determining unit that determines, based on the manipulation information, whether or not the working equipment is under a rolling compaction operation for hardening earth and sand through reciprocation, and a command output regulating unit that controls, based upon a determination by the rolling compaction determining unit that the working equipment is under the rolling compaction operation, the working equipment so that a motion speed of the working equipment does not exceed a maximum value, the command output regulating unit comprising:

a cycle computing unit that computes, based on the manipulation information, a manipulation cycle of the manipulating unit, a maximum value changing unit configured to, based on the manipulation cycle, adjust the maximum value, and a command output limiter that regulates command output of the working equipment so that the motion speed of the working equipment does not exceed the maximum value, wherein the controller further comprises a signal output unit, the signal output unit being configured to receive the regulated command output and output a corresponding command signal to the working equipment.

2. The construction machine according to claim 1, wherein the manipulation information acquiring unit is configured to acquire a manipulation signal from the manipulating unit, and the rolling compaction determining unit is configured to determine, based upon a value of the manipulation signal being a positive number and the value of the manipulation signal being inverted to a negative number immediately after the value of the manipulation signal being the positive number, whether or not the working equipment is under the rolling compaction operation is made by continuously comparing an input peak value of the manipulation signal and a peak value of the manipulation signal after a filter processing is applied to the manipulation signal.

3. The construction machine according to claim 1, wherein the manipulating unit includes a lever, and the cycle computing unit is configured to compute the manipulation cycle by computing the time required for a sequence of actions including:

inclining the lever from a neutral position to a first inclined position, returning the lever from the first inclined position to the neutral position, inclining the lever from the neutral position to a second inclined position that is opposite the first inclined position, and returning the lever from the second inclined position to the neutral position.

4. A method for controlling a construction machine comprising a working equipment, a manipulating unit that manipulates the working equipment, and a controller that controls the working equipment, the method performed by the controller comprising:

acquiring manipulation information on manipulation conditions of the manipulating unit;

determining, based on the manipulation information, whether or not the working equipment is under a rolling compaction operation for hardening earth and sand through reciprocation; and when determining that the working equipment is under the rolling compaction operation, controlling the working equipment so that a motion speed of the working equipment does not exceed a predetermined maximum value, the controlling of the working equipment comprising:

computing, based on the manipulation information, a manipulation cycle of the manipulating unit, changing, based on the manipulation cycle, the predetermined maximum value to a changed maximum value, and regulating command output of the working equipment so that the motion speed of the working equipment does not exceed the changed maximum value, wherein controlling of the working equipment further comprises sending the regulated command output to a signal output unit, the signal output unit being configured to output a corresponding command signal to the working equipment.

5. The method for controlling a construction machine according to claim 4, wherein acquiring manipulation information includes acquiring a manipulation signal from the manipulating unit, and determining whether or not the working equipment is under a rolling compaction operation includes continuously comparing, based upon a value of the manipulation signal being a positive number and the value of the manipulation signal being inverted to a negative number immediately after the value of the manipulation signal being the positive number, an input peak value of the manipulation signal and a peak value of the manipulation signal after a filter processing is applied to the manipulation signal.

6. The method for controlling a construction machine according to claim 4, wherein computing the manipulation cycle of the manipulating unit includes computing the time required for a sequence of actions including:

inclining a lever of the manipulating unit from a neutral position to a first inclined position, returning the lever from the first inclined position to the neutral position, inclining the lever from the neutral position to a second inclined position that is opposite the first inclined position, and returning the lever from the second inclined position to the neutral position.

* * * * *